United States Patent [19]

Carmody et al.

[11] Patent Number: 4,981,177

[45] Date of Patent: Jan. 1, 1991

[54] METHOD AND APPARATUS FOR ESTABLISHING COMMUNICATION WITH A DOWNHOLE PORTION OF A CONTROL FLUID PIPE

[75] Inventors: Michael A. Carmody; Erik P. V. Eriksen, both of Broken Arrow, Okla.; Lars Vinje, Hafrsfjord, Norway

[73] Assignee: Baker Hughes Incorporated, Houston, Tex.

[21] Appl. No.: 422,774

[22] Filed: Oct. 17, 1989

[51] Int. Cl.[5] ..... E21B 29/00

[52] U.S. Cl. ..... 166/376; 166/55.1; 166/55.3; 166/298

[58] Field of Search ..... 166/297, 298, 375, 376, 166/378, 386, 54.6, 54.5, 55, 55.1, 55.3, 319, 322, 323

[56] References Cited

U.S. PATENT DOCUMENTS

| | | | |
|---|---|---|---|
| 2,794,619 | 6/1957 | Lawrence et al. | 166/54.6 |
| 3,696,868 | 10/1972 | Taylor, Jr. | 166/375 |
| 3,763,932 | 10/1973 | Dinning | 166/322 |
| 3,799,258 | 3/1974 | Tausch | 166/322 |
| 3,882,935 | 5/1975 | Calhoun | 166/322 |
| 4,284,141 | 8/1981 | Mott | 166/375 |
| 4,503,913 | 3/1985 | Carmody | 166/319 |
| 4,512,411 | 4/1985 | Pringle | 166/55.5 |
| 4,534,414 | 8/1985 | Pringle | 166/376 |
| 4,660,635 | 4/1987 | Wittrisch | 166/385 |
| 4,796,705 | 1/1989 | Carmody et al. | 166/321 |

*Primary Examiner*—Bruce M. Kisliuk

*Attorney, Agent, or Firm*—Jackson and Walker

[57] ABSTRACT

A downhole tool, such as a safety valve or a stand-alone nipple, has a tubular housing. An axially extending bore is provided in the wall of the housing. A radially extending recess is provided in the internal bore wall of the housing, encompassing the axially extending bore, and a control fluid pipe is passed through the bore and the recess. A cutting tool is mounted for radial movements in the recess and is actuated by downward jarring forces imparted by an auxiliary tool. The control pipe is severed by the cutting element and the lower severed end portion of the control pipe is concurrently crimped to close such end portion.

30 Claims, 2 Drawing Sheets

METHOD AND APPARATUS FOR ESTABLISHING COMMUNICATION WITH A DOWNHOLE PORTION OF A CONTROL FLUID PIPE

BACKGROUND OF THE INVENTION

1. Field of the Invention

The invention relates to downhole tools for subteranean wells, and particularly to a method and apparatus for establishing communication with a downhole portion of a control fluid pipe extending from the well surface to the downhole tool.

2. Summary of the Prior Art

There are many downhole tools which are responsive to fluid pressure transmitted through a small auxiliary line, sometimes referred to as a hydraulic control line. These lines transmit fluid from the top of the well and enter the interior of production tubing, a work string, casing, or the like, at some point at a depth in the well. Safety valves are typical of such hydraulically activated downhole tools.

A very popular form of a downhole safety valve comprises the so-called "full bore opening" type which refers to a safety valve wherein the bore opening through the valve when it is disposed in its open position is substantially equal to the internal bore diameter of the tubing string in which the safety valve is incorporated. Such full bore opening valves may employ a rotatable ball or a pivoted flapper as the shiftable valve head. In either case, the valve head is shifted to its full open position by an actuating sleeve which is axially shiftably mounted within the bore of the valve housing and is operated by one or more hydraulic cylinders to shift the actuating sleeve downwardly and effect the movement of the valve head to its full open position. Pressure control fluid for operating the cylinder is supplied from the surface by the small diameter pipe or tubing which communicates with a control fluid passage in the wall of the valve housing, or through a nipple disposed in the production or work string.

A valve of this general type is shown in U.S. Pat. Nos. 4,503,913 and 4,796,705. The latter patent provides a secondary actuating cylinder for effecting the locking of the movable head of the safety valve in its full open position in the event of any failure or defect in the operation of the primary cylinder.

It is highly desirable to replace any defective safety valve by a functional safety valve, and this has been accomplished in the past by inserting so-called in-tubing safety valve within the bore of the original defective safety valve while the original defective safety valve is in its locked, full open position. Such replacement valves are generally inserted by wireline, hence the problem arises as to how the already installed control fluid piping can be utilized to effect the control of the replacement valve.

U.S. Pat. No. 3,696,868 discloses an in-tubing replacement valve for an installed defective safety valve wherein the wall of the actuating sleeve for the defective valve is perforated prior to the insertion of the replacement valve to provide communication with the existing control fluid conduit. Obviously, the production of perforations in an installed sleeve without damaging surrounding elements is a difficult operation.

Prior art arrangements have also utilized ports in the original valve housing communicating with the control fluid conduit and provided seal elements for such ports or threaded plugs which were then removed by the insertion of the replacement safety valve. Obviously, any time a seal or threaded plug is employed in a downhole environment, there is a distinct possibility that such seal or threads will leak and produce undesirable effects on the operation of the well.

U.S. Pat. No. 3,799,258 proposes the utilization of a hollow, shearable threaded plug traversing the wall of the valve housing with the inwardly projecting end of the plug being sheared off by a sleeve which is moved downwardly by "a suitable tool". This arrangement has several obvious disadvantages. Since the original safety valve may function properly for many years, the successive passages of well treatment and/or other tools downwardly through the safety valve always involves the danger that the inwardly projecting end of the hollow plug may be accidentally sheared off, thus rendering the installed safety valve inoperative. Furthermore, leakage around the threaded plug by high pressure, highly corrosive well fluids is a constant threat.

Accordingly, the prior art has not provided an adequate solution to the problem of effecting trouble free fluid communication of control fluid to a replacement in-tubing safety valve through the control fluid piping already existing in an installed defective safety valve.

SUMMARY OF THE INVENTION

In accordance with the method and apparatus of this invention, the upper portion of the tubular housing of any conventional downhole fluid pressure operated well tool, such as a safety valve, or the housing of a stand-alone nipple, is provided with an axially extending bore in its wall. Such tool may be that as shown in the aforementioned U.S. Pat. No. 4,796,705, the disclosure of which is incorporated herein by reference.

A radially outwardly extending recess is then formed in the inner bore wall of the housing, with such recess encompassing the axially extending bore. The control fluid pipe which transmits control fluid to the downhole tool is then inserted through both the axially extending bore and the encompassing recess and continues on down to a conventional connection to the fluid pressure operated mechanism of the particular tool.

Within the radial recess, a cutting tool is mounted for radial movement. Such cutting tool is engagable by a wedge element which in turn is supported on and downwardly movable by a wedge support sleeve. The wedge support sleeve is provided with an internal contour permitting the detachable engagement of a wireline tool to such sleeve. The wireline preferably incorporates jar elements.

Thus, operation of the wireline jars imparts successive downward forces to the wedge support sleeve, which, in turn, produces a radially outward displacement of the cutting tool to effect the severing of the control fluid pipe. A lock is provided to secure the wedge support sleeve in its position corresponding to the complete severing of the control fluid pipe.

The cutting tool also incorporates a crimping tool which is disposed slightly below the blade of the cutting tool. Such crimping tool concurrently effects the crimping of the severed lower end portion of the control fluid pipe.

To permit the insertion of a substitute tool in the bore of the housing of the original tool, such housing bore is provided with seal bore portions respectively located above and below the recess. Thus, a replacement tool, such as an in-tubing safety valve, may be inserted by wireline into sealable engagement with the axially spaced seal bores. Pressured control fluid supplied through the upper severed end of the control fluid pipe is then trapped between the seals and may be directed to enter the interior of the replacement tool to effect the fluid pressure operation of such tool. The crimping of the lower severed end portion of the control pipe obviously prevents loss of pressurized control fluid down such pipe. Hence, a reliable fluid pressure operation of the replacement tool may be effected.

Other advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENTS

Figure 1:
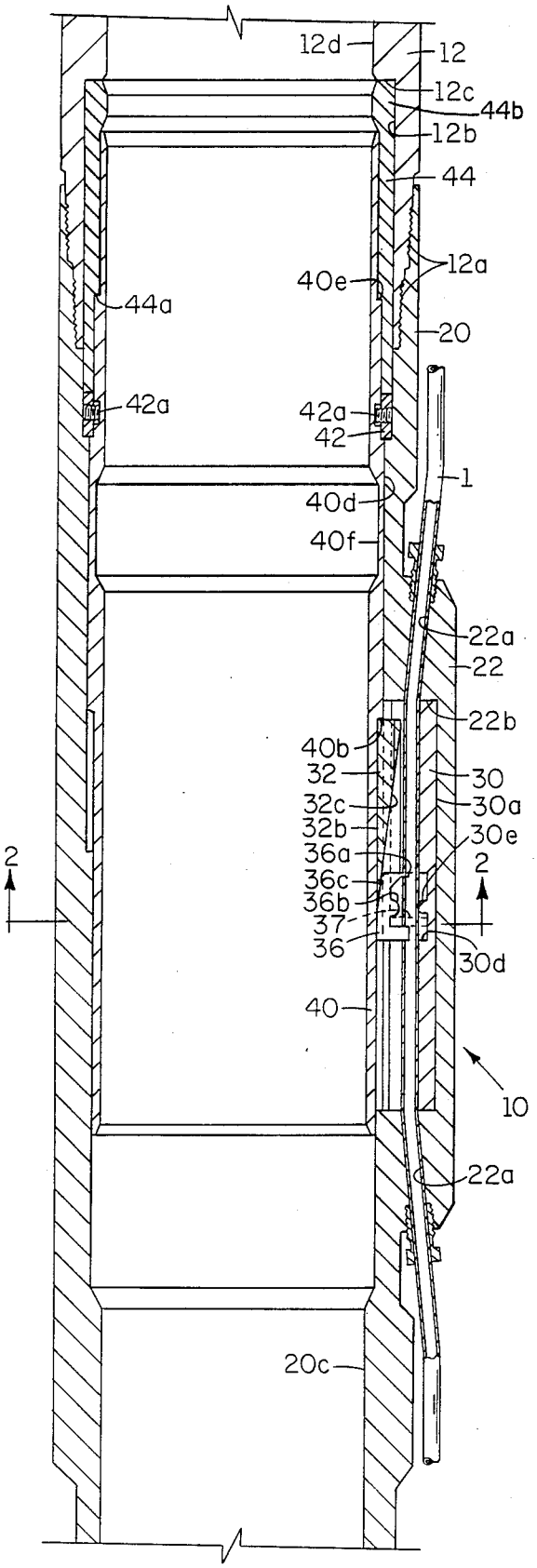
FIG. 1 constitutes a vertical quarter sectional view of a downhole tool embodying this invention, with the elements of the tool shown in their run-in or inoperative position.

Referring to FIG. 1, there is shown an upper housing portion 10 for a downhole safety valve. Such safety valve can be of any conventional configuration, for example, the configuration shown in the aforementioned prior art patents, but in every case involves fluid pressure operated apparatus which is supplied with a pressured control fluid by a separate conduit 1 extending from the well surface to the downhole tool. Housing 10 is provided with an upper sub portion 12 for connection in series relationship with a tubing string (not shown) extending to the well surface. Below the upper sub 12, a special housing 20 embodying the construction of this invention is connected to upper sub 12 by threads **12*a*. Housing 20 has a radially thickened wall portion 22 on its medial portion. Such wall defines an axially extending bore 22*a* through which the control fluid conduit 1 may be inserted. The control fluid conduit 1** extends from a source of pressure control fluid at the surface downwardly to a stand-alone nipple or the like, or conventional fluid pressure apparatus (not shown), such as any one of the safety valves disclosed in the aforementioned U.S. Patents.

Figure 2:
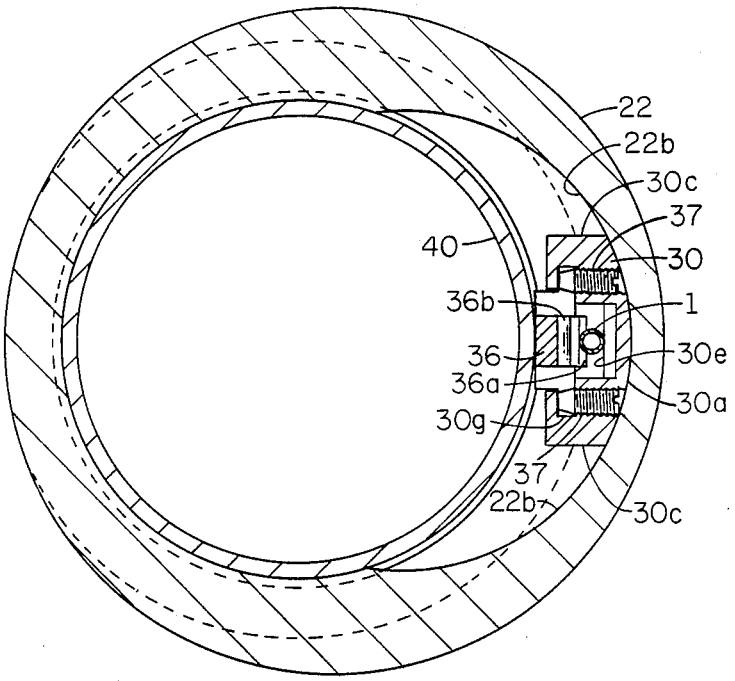
FIG. 2 is a sectional view taken on the plane 2—2 of FIG. 1.

The thickened wall portion 22 of the housing 20 is further provided with a radially extending recess **22*b* which encompasses the medial portion of the bore 22*a* and hence surrounds the inserted control fluid conduit 1. The configuration of such recess is best shown in the sectional view of FIG. 2. A block 30 having a cylindrical segment external surface 30*a* is inserted in the recess 22*b* and is secured therein by an actuating sleeve 40 which is mounted within the bore 20*a* of the tubular housing 20. Block 30 is axially traversed by a bore 30*b* through which the control conduit 1** is inserted.

Figure 4:
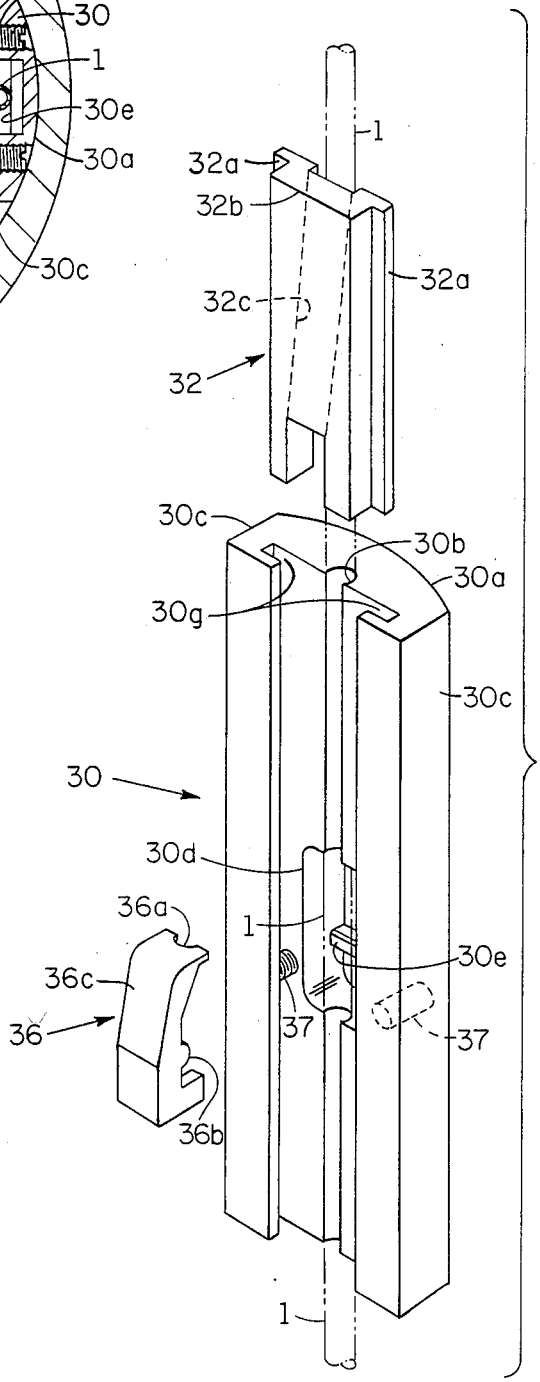
FIG. 4 is an enlarged scale, exploded perspective view of the wedge block, wedge and cutting tool incorporated in the apparatus.

Block 30 is of generally inverted U-shaped configuration having a top wall **30*a* and side walls 30*c* (FIG. 4). Side walls 30*c* define an axially extending T-slot 30*g* and a wedge element 32 is slidably mounted in such slot by virtue of laterally projecting wings 32*a* provided on each side of the wedge element 32. The radially inner surface 32*b* of wedge element 32 abuts the external surface 40*a* of the actuating sleeve 40. In FIG. 1, the wedge element 32 is shown in its upper or inoperative position in the T-slot 30*g* of the insert block 30**.

In the medial portions of insert block 30, a generally radially extending, rectangular cross-sectional recess **30*d* is provided to mount a cutting element 36 (FIG. 4). Cutting element 36 is slidably mounted in the recess 30*d* for generally radial movement which will carry a blade portion 36*a* of the cutting element 36 into severing engagement with the control conduit 1. Wedge element 32 is prevented from moving cutting tool 36 into engagement with the conduit 1 by shear screws 37**.

Integrally formed on the cutting element 36, but spaced axially below the cutting blade **36*a*, is a crimping tool 36*b*. Such crimping tool is dimensioned to engage the inserted control conduit 1 and effect a crimping action on the lower severed end thereof against a rib 30*e* on the outer wall of recess 30*d* concurrently with the severing of conduit 1 by the cutting blade 36*a*. Such cutting and crimping action is produced by the inclined ramp surface 32*c* formed on the radially outer surface of the wedge 32. This surface engages a correspondingly shaped bottom surface 36*c* formed on the cutting element 36**.

The actuating sleeve 40 is provided with a downwardly facing shoulder **40*b* immediately above the upper end of the wedge 32** in the run-in or inoperative position of such wedge.

The actuating sleeve is secured in its inoperative or run-in position by a plurality of peripherally spaced shear screws **42*a* which are mounted in a C-ring 42 which surrounds a cylindrical surface 40*d* provided on the upper portions of the actuating sleeve 40. The actuating sleeve 40 is provided with an upwardly facing shoulder 40*e* which is engaged by a downwardly facing shoulder 44*a* formed on a spacer sleeve 44. The top end 44*b* of spacer sleeve 44 lies below a downwardly facing surface 12*c* defined by an annular recess 12*b* formed in the bottom of the top sub 12**.

The medial portion of the actuating sleeve 40 is provided with an internal contour **40*f* which may be engaged by a conventional wireline tool (not shown) or other device for imparting downward jarring forces to the actuating sleeve 40. The utilization of a wireline incorporating jars and other devices having appropriate radially shiftable elements for engagement with the internal sleeve contour 40*f*** is well known in the art, hence further description or illustration thereof is deemed to be unnecessary.

The operation of the apparatus heretofore described, and the method embodied in such operation will be readily apparent to those skilled in the art. Upon engagement of a wireline tool (not shown) with the internal wireline tool contour **40*f* of the actuating sleeve 40, a series of downward jarring forces are applied to the actuating sleeve 40. The first effect of such sources is to shear the shear screws 42*a* and thus permit the actuating sleeve 40 to move downwardly so that the downwardly facing shoulder 40*b* on the actuating sleeve engages the top end of the wedge 32, thus driving the wedge downwardly. The downward movement of the wedge 32 effects a shearing of the shear screws 37, thus the blade portion 36*a* and the crimping portion 36*b* of the cutting element 36 are concurrently urged radially outwardly by wedge 32 into operative engagement with the inserted control fluid conduit 1. The cutting element 36a effects the severing of the conduit 1 while concurrently, the crimping element 36b effects the crimping of the lower severed portion of the conduit 1. Thus, control fluid may be supplied to the interior of the bore of the housing 10 through the severed end of the conduit 1, while such control fluid is prevented from entering the lower end of the control fluid conduit 1 by the crimping action of the crimping tool 36b**.

Figure 3:
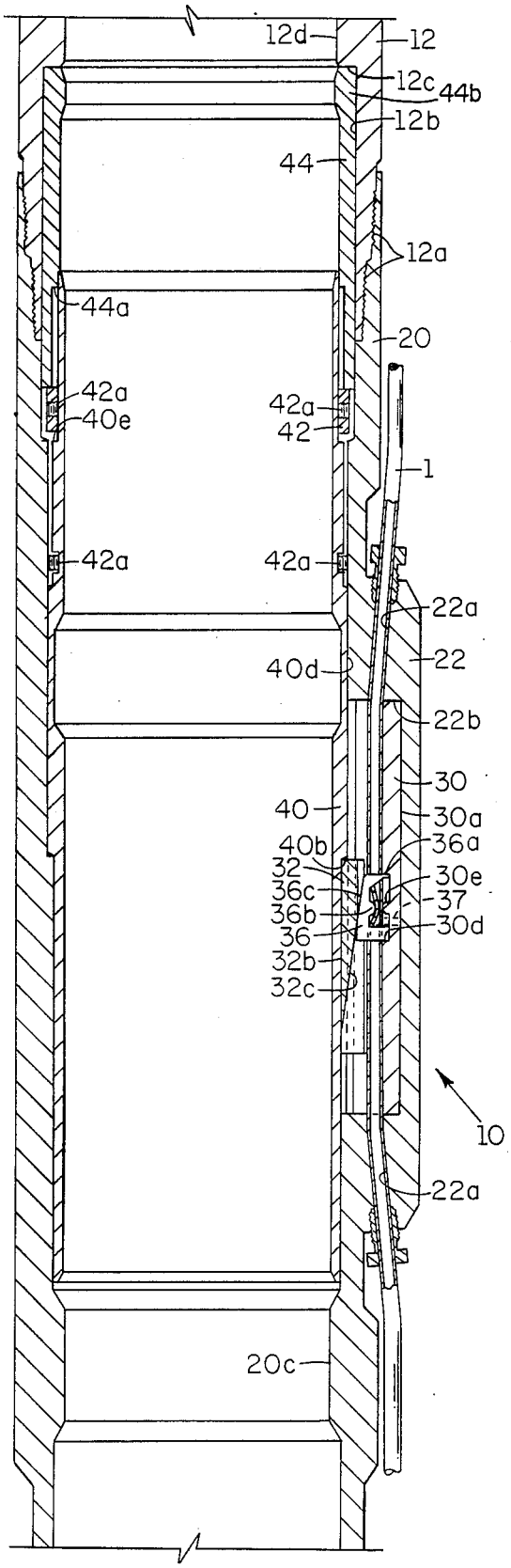
FIG. 3, is a view similar to FIG. 1 but showing the elements of the tool in their activated positions for effecting connection to a downhole control fluid conduit.

The actuating sleeve 40 is moved downwardly to fully advance the wedge 32 beneath the cutting element 36, and hence move the cutting blade 36a completely through the control fluid conduit 1. Such final position of the cutting element 36 is shown in FIG. 3. In such position, the upwardly facing shoulder 40e provided on the actuating sleeve 40 is engaged by the C-ring 42 which snaps into engagement above such shoulder and hence secures the actuating sleeve in its downward, fully severing position.

In accordance with this invention, the upper sub 12 is provided with a cylindrical seal bore surface 12d above the actuating sleeve 40 and the tubular housing 20 is provided with an axially extending seal bore surface 20c below the thickened wall portion 22. The provision of these seal bores permits an in-tubing safety valve (not shown) or other tool to be inserted by wireline or the like, in sealing engagement with the two seal bores respectively located above and below the severed end of the control fluid conduit 1. Suitable inlets for pressured control fluid are provided on the exterior of the inserted in-tubing safety valve or other tool in conventional fashion and such in-tubing safety valve or other tool may be operated by pressured control fluid supplied through the severed end of the existing control fluid conduit 1.

Those skilled in the art will particularly appreciate the fact that access to the control fluid conduit 1 is provided without the utilization of any form of seals or plugs. Thus, the failure of such prior art access components prior to the time that an in-tubing safety valve or other tool must be inserted is completely eliminated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of establishing communication with a downhole portion of a control fluid conduit extending from the surface to a downhole tool in a subterranean well, said downhole tool having a tubular housing portion, comprising the steps of:

providing an axially extending bore in the wall of said tubular housing portion;

providing a recess in the bore wall of said tubular housing portion encompassing a portion of said axially extending bore;

running a control fluid conduit through said axially extending bore and said recess;

mounting a cutting element in said recess for radial movement;

mounting a wedge element in said tubular housing portion for axial movement relative to said cutting element; and inserting engaging means in the well for detachable engagement relative to said wedge element, whereby activation of said engaging means relatively moves said wedge element into operative engagement with said cutting element to shift said cutting element radially to sever said control fluid conduit.

2. The method of claim 1 further comprising the step of crimping the lower severed end portion of the control fluid conduit.

3. The method of claim 2 wherein said crimping of the lower severed end of the control fluid conduit is accomplished by a crimping head on said cutting element.

4. The method of establishing communication with a downhole portion of a control fluid conduit extending from the surface to a downhole tool in a subterranean well, said downhole tool having a tubular housing portion, comprising the steps of:

(1) prior to inserting the downhole tool in the well:

a. providing an axially extending bore in the wall of said tubular housing;

b. providing a recess in the bore wall of tubular housing portion encompassing a portion of said axially extending bore;

c. mounting a cutting element in said recess for generally radial movement;

d. mounting a wedge element in said housing portion for axial movement relative to said cutting element;

(2) prior to insertion of the downhole tool in the well, inserting a control fluid conduit through said axially extending bore and said recess;

(3) after insertion of the downhole tool in the well:

a. inserting engaging means in the well for detachable engagement with said wedge element;

b. actuating said activating tool to move said wedge element into relative operative engagement with said cutting element to shift said cutting element radially to sever said control fluid conduit.

5. The method of claim 4 further comprising the step of:

crimping the lower severed end of the control fluid conduit concurrently with the severing of the control fluid conduit.

6. The method of claim 5 wherein said crimping of the lower severed end of the control fluid conduit is accomplished by a crimping head on said cutting element.

7. The method of claim 1 or 4 further comprising the steps of:

removing the engaging means from the well; and inserting a second fluid pressure operated tool in the well in sealing engagement with the bore of said tubular housing above and below said recess, whereby pressured control fluid may be supplied to said second downhole tool through the upper severed end of said control fluid conduit.

8. Apparatus for establishing downhole fluid communication with an installed control fluid conduit comprising, in combination:

a downhole fluid pressure operated tool having a tubular housing;

an axially extending bore in the wall of said tubular housing;

a control fluid conduit passing through said axially extending bore;

a recess in the bore wall of said housing encompassing a portion of said control fluid conduit;

a cutting tool block having a cutting edge;

said cutting tool block being mounted in said recess for generally radial movement relative to said tubular housing with said cutting edge disposed on the radially outer portion of said cutting tool block;

a wedge element mounted in said recess for axial movement;

a wedge actuating sleeve;

said wedge actuating sleeve being axially shiftably mounted in the bore of said tubular housing to move said wedge element into operative engagement with said cutting tool block; and engaging means for shifting said wedge actuating sleeve to cause said wedge element to activate said cutting tool to sever said control fluid conduit.

9. The apparatus of claim 8 further comprising a crimping tool mounted on said cutting tool block below said cutting edge;

said crimping tool being engagable with the lower severed end portion of said control fluid conduit to close said lower severed end.

10. The apparatus of claim 8 further comprising axially spaced seal bores in said tubular housing disposed above and below said recess, whereby a second fluid pressure operated tool may be inserted in said tubular housing in sealing engagement with said seal bores to receive pressured control fluid from the upper severed end of said control fluid conduit.

11. The apparatus of claim 8 further comprising shearable means for securing said wedge actuating sleeve to said tubular housing in an inoperative position relative to said wedge element, said shearable means being shearable by force applied by said engaging means.

12. The apparatus of claim 8 or 11 further comprising means for locking said wedge actuating sleeve to said tubular housing in its position corresponding to the final position of said cutting tool after severing said control fluid conduit.

13. Apparatus of establishing downhole fluid communication with an installed control fluid conduit comprising, in combination:

a downhole fluid pressure operated tool having a tubular housing;

an axially extending bore in the wall of said tubular housing;

a control fluid conduit passing through said axially extending bore;

a recess in the bore wall of said housing encompassing a portion of said control fluid conduit;

a cutting tool having a cutting edge;

means for mounting said cutting tool in said recess for generally radial movement relative to said tubular housing; and engaging means for moving said cutting tool mounting means to sever said control fluid conduit by said cutting tool.

14. The apparatus of claim 13 further comprising a crimping tool mounted on said cutting tool below said cutting edge;

said crimping tool being engagable with the lower severed end portion of said control fluid conduit to close said lower severed end.

15. The apparatus of claim 13 further comprising axially spaced seal bores in said tubular housing disposed above and below said recess, whereby a second fluid pressure operated tool may be inserted in said tubular housing in sealing engagement with said seal bores to receive pressured control fluid from the upper severed end of said control fluid conduit.

16. The apparatus of claim 13 further comprising shearable means for securing said cutting tool in an inoperative position relative to said control fluid conduit prior to actuation of said engaging means.

17. The apparatus of claim 13 further comprising means for locking said engaging means relative to said tubular housing when said cutting tool reaches a position corresponding to full severing of said control fluid conduit.

18. Apparatus for establishing downhole fluid communication with an installed control fluid conduit comprising, in combination:

a downhole fluid pressure operated tool having a tubular housing;

an axially extending bore in the wall of said tubular housing;

an axially extending radial chamber in the bore wall of said housing encompassing a medial portion of said axially extending bore;

a block snugly insertable in said chamber;

said block defining an axially extending hole in series alignment with said axially extending bore;

a control fluid conduit passing through said axially extending bore and said block hole;

said block defining an axially extending guide slot in its radially inner surface;

a wedge mounted in said guide slot for downward movement;

a radial recess in the lower portion of said block encompassing a portion of said control fluid conduit;

a cutting tool mounted in said recess for radial movement produced by movement of said wedge; and means for moving said wedge thereby severing said control fluid pipe.

19. The apparatus of claim 18 further comprising a crimping tool mounted on said cutting tool;

said crimping tool being engagable with the lower severed end portion of said pipe to crimp same closed.

20. The apparatus of claim 18 further comprising axially spaced seal bores in said tubular housing disposed above and below said chamber, whereby a second fluid pressure operated tool may be inserted in said tubular housing in sealing engagement with said seal bores to receive pressured control fluid from the upper severed end of said control fluid conduit.

21. The apparatus of claim 18 further comprising a sleeve having an internal bore configuration detachably engagable by a wireline tool to receive actuating forces; and said sleeve having a downwardly facing external shoulder disposed above and abuttable with said wedge.

22. The apparatus of claim 21 further comprising shearable means for securing said sleeve to said tubular housing in an inoperative position relative to said wedge element, said shearable means being shearable by force applied by a wireline tool.

23. The apparatus of claim 21 further comprising means for locking said sleeve to said tubular housing in its downward position corresponding to the final position of said cutting tool after severing said control fluid conduit.

24. The apparatus of claim 18 further comprising shearable means for securing said wedge in an inoperative position relative to said cutting tool prior to actuation of said wireline operable means.

25. The method of establishing communication with a downhole portion of a control fluid conduit extending from the surface to a downhole tool in a subterranean well, said downhole tool having a tubular housing portion, comprising the steps of:

providing an axially extending bore in the wall of said tubular housing portion;

providing a recess in the bore wall of said tubular housing portion encompassing a portion of said axially extending bore;

running a control fluid conduit through said axially extending bore and said recess;

mounting a cutting element in said recess for radial movement;

providing an axially shiftable wedge engagable with said cutting element to move said cutting tool radially;

inserting a wireline tool with jars in the well for detachable engagement with said axially shiftable wedge; and translating jarring movements of said wireline tool by said wedge into radial outward movements of said cutting element to sever said control fluid conduit.

26. The method of claim 25 further comprising the step of concurrently crimping the lower severed end portion of the control fluid conduit.

27. The method of claim 26 wherein said crimping of the lower severed end of the control fluid conduit is accomplished by a crimping tool on said cutting element.

28. The method of claim 25 further comprising the step of locking said cutting element in its position corresponding to complete severing of said control fluid conduit.

29. The apparatus of claim 9 or 14 further comprising abutment means in said recess engagable with the control fluid conduit opposite said crimping tool.

30. The apparatus of claim 19 further comprising an abutment ridge in said radial recess engagable with the control fluid conduit opposite said crimping tool.

* * * * *